US009447359B2

(12) United States Patent
Matsui et al.

(10) Patent No.: US 9,447,359 B2
(45) Date of Patent: Sep. 20, 2016

(54) LUBRICANT COMPOSITION

(75) Inventors: Shigeki Matsui, Yokohama (JP); Akira Yaguchi, Yokohama (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 865 days.

(21) Appl. No.: 12/812,524

(22) PCT Filed: Jan. 9, 2009

(86) PCT No.: PCT/JP2009/050233

§ 371 (c)(1),
(2), (4) Date: Oct. 4, 2010

(87) PCT Pub. No.: WO2009/090921

PCT Pub. Date: Jul. 23, 2009

(65) Prior Publication Data

US 2011/0053815 A1 Mar. 3, 2011

(30) Foreign Application Priority Data

Jan. 15, 2008 (JP) ..... 2008-006024

(51) Int. Cl.
*C10M 169/04* (2006.01)

(52) U.S. Cl.
CPC .... *C10M 169/04* (2013.01); *C10M 2203/1025* (2013.01); *C10M 2207/289* (2013.01); *C10M 2209/084* (2013.01); *C10M 2215/102* (2013.01); *C10M 2217/023* (2013.01); *C10M 2217/028* (2013.01); *C10M 2219/068* (2013.01); *C10N 2220/021* (2013.01); *C10N 2220/022* (2013.01); *C10N 2220/024* (2013.01); *C10N 2220/025* (2013.01); *C10N 2220/031* (2013.01); *C10N 2230/02* (2013.01); *C10N 2230/54* (2013.01); *C10N 2230/68* (2013.01); *C10N 2240/10* (2013.01)

(58) Field of Classification Search
CPC ..... C10M 169/04; C10M 2203/1025; C10M 2207/289; C10M 2209/084; C10M 2215/102; C10M 2217/023; C10M 2217/028; C10M 2219/068; C10N 2220/021; C10N 2220/022; C10N 2220/024; C10N 2220/025; C10N 2220/031; C10N 2230/02; C10N 2230/54; C10N 2230/68; C10N 2240/10
USPC ..... 508/384, 469
See application file for complete search history.

(56) References Cited

U.S. PATENT DOCUMENTS 2,861,941 A 11/1958 Jancosek et al.
2,890,161 A 6/1959 Brown et al.
3,078,222 A 2/1963 Henke et al.
3,847,790 A 11/1974 Putz
4,021,357 A * 5/1977 Morduchowitz et al. .... 508/471
4,867,894 A * 9/1989 Pennewiss et al. ..... 508/470
5,282,958 A 2/1994 Santilli et al.
5,362,378 A 11/1994 Borghard et al.
5,652,201 A 7/1997 Papay et al.

(Continued)

FOREIGN PATENT DOCUMENTS

CA 2 682 660 10/2008
CN 1279708 1/2001

(Continued)

OTHER PUBLICATIONS

Notification of Information Provision issued with respect to Japanese Patent Application No. 2009-135369, mailed May 29, 2012.

(Continued)

*Primary Examiner* — James Goloboy
(74) *Attorney, Agent, or Firm* — Greenblum & Bernstein, P.L.C.

(57) ABSTRACT

The invention provides a lubricating oil composition comprising:

a lubricating base oil having a kinematic viscosity at 100° C. of 1-10 $mm^2/s$, a % $C_p$ of 70 or greater and a % $C_A$ of not greater than 2;

a first viscosity index improver of 0.01-10% by mass, based on the total weight of the composition, wherein the first viscosity index improver is a poly(meth)acrylate having a weight-average molecular weight of not greater than 100,000; and a second viscosity index improver of 0.01-50% by mass, based on the total weight of the composition, wherein the second viscosity index improver is a polymer having a weight-average molecular weight of 100,000 or greater and containing a structural unit represented by the following formula (1) in a proportion of 0.5-70 mol %, the composition having a kinematic viscosity at 100° C. of 4-12 $mm^2/s$ and a viscosity index of 140-300.

[Chemical Formula 1]

(1)

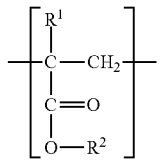

wherein $R^1$ represents hydrogen or a methyl group and $R^2$ represents a C16 or greater straight-chain or branched hydrocarbon, or an oxygen- and/or nitrogen-containing C16 or greater straight-chain or branched organic group.

5 Claims, No Drawings

(56) References Cited

U.S. PATENT DOCUMENTS

| | | | | |
|---|---|---|---|---|
| 5,763,374 | A | 6/1998 | Sakai et al. | |
| 5,955,405 | A * | 9/1999 | Liesen et al. | 508/469 |
| 6,077,455 | A | 6/2000 | Bloch et al. | |
| 6,090,989 | A | 7/2000 | Trewella et al. | |
| 6,383,366 | B1 | 5/2002 | Riley et al. | |
| 6,602,402 | B1 | 8/2003 | Benazzi et al. | |
| 7,285,206 | B2 | 10/2007 | Germaine | |
| 7,867,957 | B2 | 1/2011 | Matsui et al. | |
| 2001/0056044 | A1 | 12/2001 | Kinker et al. | |
| 2002/0119896 | A1 | 8/2002 | Yagishita et al. | |
| 2003/0036488 | A1 | 2/2003 | Yuki et al. | |
| 2003/0104955 | A1 | 6/2003 | Yuki et al. | |
| 2003/0162673 | A1 | 8/2003 | Kurihara et al. | |
| 2003/0226785 | A1 | 12/2003 | Murphy et al. | |
| 2004/0045868 | A1 | 3/2004 | Germaine | |
| 2004/0065588 | A1 | 4/2004 | Genetti et al. | |
| 2004/0077509 | A1 | 4/2004 | Yuki et al. | |
| 2004/0079675 | A1 | 4/2004 | Germaine et al. | |
| 2004/0092409 | A1 | 5/2004 | Liesen | |
| 2004/0099571 | A1 | 5/2004 | Germaine et al. | |
| 2004/0108249 | A1 | 6/2004 | Cody et al. | |
| 2004/0112792 | A1 | 6/2004 | Murphy et al. | |
| 2004/0119046 | A1 | 6/2004 | Carey et al. | |
| 2004/0129603 | A1 | 7/2004 | Fyfe et al. | |
| 2004/0154957 | A1 | 8/2004 | Keeney et al. | |
| 2004/0154958 | A1 | 8/2004 | Alexander et al. | |
| 2004/0198616 | A1 | 10/2004 | Hirao et al. | |
| 2004/0224860 | A1 | 11/2004 | Baba et al. | |
| 2005/0077209 | A1 | 4/2005 | Miller et al. | |
| 2005/0221998 | A1 | 10/2005 | Marumo et al. | |
| 2006/0027486 | A1 | 2/2006 | Rosenbaum et al. | |
| 2006/0052252 | A1 | 3/2006 | Wedlock | |
| 2006/0172900 | A1 | 8/2006 | Yagishita et al. | |
| 2006/0205610 | A1 | 9/2006 | Rosenbaum et al. | |
| 2007/0032392 | A1 | 2/2007 | Yokoyama et al. | |
| 2007/0138032 | A1 | 6/2007 | Agarkov | |
| 2007/0138052 | A1 | 6/2007 | Kobayashi et al. | |
| 2007/0191239 | A1 | 8/2007 | Matsuoka et al. | |
| 2007/0238627 | A1 | 10/2007 | Haire et al. | |
| 2007/0287643 | A1 | 12/2007 | Matsui et al. | |
| 2008/0015400 | A1 | 1/2008 | Matsui et al. | |
| 2008/0029430 | A1 * | 2/2008 | Loh et al. | 208/19 |
| 2008/0029431 | A1 | 2/2008 | Alexander et al. | |
| 2008/0110799 | A1 | 5/2008 | Matsui et al. | |
| 2008/0248981 | A1 | 10/2008 | Matsui et al. | |
| 2009/0005278 | A1 | 1/2009 | Takeuchi et al. | |
| 2009/0075852 | A1 | 3/2009 | Yagishita et al. | |
| 2009/0221461 | A1 | 9/2009 | Visger et al. | |
| 2009/0312208 | A1 | 12/2009 | Ishikawa et al. | |
| 2010/0016195 | A1 | 1/2010 | Shirahama et al. | |
| 2010/0035777 | A1 | 2/2010 | Sano et al. | |
| 2010/0041572 | A1 | 2/2010 | Sano et al. | |
| 2010/0093578 | A1 | 4/2010 | Tsujimoto et al. | |
| 2010/0130395 | A1 | 5/2010 | Tagawa et al. | |
| 2010/0144571 | A1 | 6/2010 | Shirahama et al. | |
| 2010/0190671 | A1 | 7/2010 | Stoehr et al. | |
| 2011/0003725 | A1 | 1/2011 | Matsui et al. | |
| 2011/0021394 | A1 | 1/2011 | Nakao et al. | |
| 2011/0042267 | A1 | 2/2011 | Hayasaka | |
| 2011/0049008 | A1 | 3/2011 | Tagawa et al. | |
| 2011/0049009 | A1 | 3/2011 | Tagawa et al. | |
| 2011/0053815 | A1 | 3/2011 | Matsui et al. | |
| 2011/0065618 | A1 | 3/2011 | Tagawa | |
| 2011/0124536 | A1 | 5/2011 | Matsui | |
| 2011/0218131 | A1 | 9/2011 | Tsujimoto et al. | |
| 2011/0230685 | A1 | 9/2011 | Tagawa | |
| 2011/0237477 | A1 | 9/2011 | Tagawa et al. | |
| 2011/0306530 | A1 | 12/2011 | Manabe et al. | |
| 2012/0071373 | A1 | 3/2012 | Matsui et al. | |
| 2012/0071374 | A1 | 3/2012 | Yaguchi et al. | |
| 2012/0071375 | A1 | 3/2012 | Yaguchi et al. | |
| 2012/0135900 | A1 | 5/2012 | Matsui et al. | |
| 2012/0157361 | A1 | 6/2012 | Mutou et al. | |

FOREIGN PATENT DOCUMENTS

| | | |
|---|---|---|
| CN | 1751115 | 3/2006 |
| CN | 1317368 C | 5/2007 |
| CN | 101065469 | 10/2007 |
| CN | 101213277 | 7/2008 |
| CN | 101426879 | 5/2009 |
| EP | 1 749 876 | 2/2007 |
| EP | 1 808 476 | 7/2007 |
| EP | 1 845 151 | 10/2007 |
| EP | 2 011 855 | 8/2008 |
| EP | 2 009 074 | 12/2008 |
| EP | 2 009 084 | 12/2008 |
| EP | 2 011 854 | 1/2009 |
| EP | 2 112 217 | 10/2009 |
| EP | 2135928 | 12/2009 |
| EP | 2 241 611 | 10/2010 |
| EP | 2264131 | 12/2010 |
| EP | 2264133 | 12/2010 |
| EP | 2 319 908 | 5/2011 |
| GB | 2407100 | 4/2005 |
| JP | S30-000624 | 2/1955 |
| JP | S31-003928 | 5/1956 |
| JP | S45-019183 | 7/1970 |
| JP | S48-025003 | 4/1973 |
| JP | 63-223094 | 9/1988 |
| JP | S63-309592 | 12/1988 |
| JP | 3-100099 | 4/1991 |
| JP | 4-030391 | 2/1992 |
| JP | 4-036391 | 2/1992 |
| JP | 4-068082 | 3/1992 |
| JP | 4-120193 | 4/1992 |
| JP | H5-508876 | 12/1993 |
| JP | 6-145258 | 5/1994 |
| JP | 6-306384 | 11/1994 |
| JP | 7-048421 | 2/1995 |
| JP | 7-062372 | 3/1995 |
| JP | 8-183988 | 7/1996 |
| JP | 8-302378 | 11/1996 |
| JP | 9-003463 | 1/1997 |
| JP | 2000-063439 | 2/2000 |
| JP | 2000-63877 | 2/2000 |
| JP | 2000-345170 | 12/2000 |
| JP | 2000-345171 | 12/2000 |
| JP | 2001-514301 | 9/2001 |
| JP | 2001-279278 | 10/2001 |
| JP | 2001-279287 | 10/2001 |
| JP | 2002-503754 | 2/2002 |
| JP | 2002-503755 | 2/2002 |
| JP | 2002-129182 | 5/2002 |
| JP | 2002-521499 | 7/2002 |
| JP | 2002-302687 | 10/2002 |
| JP | 2004-10799 | 1/2004 |
| JP | 2004-124080 | 4/2004 |
| JP | 2004-169029 | 6/2004 |
| JP | 2004-526831 | 9/2004 |
| JP | 2004-528426 | 9/2004 |
| JP | 2005-154760 | 6/2005 |
| JP | 2005-171186 | 6/2005 |
| JP | 2005-213447 | 8/2005 |
| JP | 2005-290238 | 10/2005 |
| JP | 2005-530902 | 10/2005 |
| JP | 2006-502297 | 1/2006 |
| JP | 2006-502298 | 1/2006 |
| JP | 2006-45277 | 2/2006 |
| JP | 2006-509899 | 3/2006 |
| JP | 2006-219642 | 8/2006 |
| JP | 2006-518395 | 8/2006 |
| JP | 2006-241436 | 9/2006 |
| JP | 2006-241437 | 9/2006 |
| JP | 2006-521416 | 9/2006 |
| JP | 2006-274209 | 10/2006 |
| JP | 2006-117851 | 11/2006 |
| JP | 2006-117853 | 11/2006 |
| JP | 2007-016172 | 1/2007 |
| JP | 2007-045850 | 2/2007 |
| JP | 2007-217494 | 8/2007 |
| JP | 2007-246659 | 9/2007 |
| JP | 2007-246661 | 9/2007 |

(56) References Cited

FOREIGN PATENT DOCUMENTS

| | | |
|---|---|---|
| JP | 2007-246662 | 9/2007 |
| JP | 2007-262239 | 10/2007 |
| JP | 2007-269885 | 10/2007 |
| JP | 2007-270059 | 10/2007 |
| JP | 2007-270062 | 10/2007 |
| JP | 2007-284635 | 11/2007 |
| JP | 2007-297528 | 11/2007 |
| JP | 2007-326963 | 12/2007 |
| JP | 2008-013281 | 1/2008 |
| JP | 2008-13681 | 1/2008 |
| JP | 2008-013684 | 1/2008 |
| JP | 2008-509244 | 3/2008 |
| JP | 2008-120908 | 5/2008 |
| JP | 2008-120909 | 5/2008 |
| JP | 2008-184569 | 8/2008 |
| JP | 2008-231189 | 10/2008 |
| JP | 2008-231190 | 10/2008 |
| JP | 2008-231191 | 10/2008 |
| JP | 2008-274236 | 11/2008 |
| JP | 2008-274237 | 11/2008 |
| JP | 2008-274238 | 11/2008 |
| JP | 2008-303344 | 12/2008 |
| JP | 2009-096925 | 5/2009 |
| JP | 2009-167278 | 7/2009 |
| JP | 2009-074068 | 9/2009 |
| JP | 2010-532805 | 10/2010 |
| WO | 9603359 | 2/1996 |
| WO | 99/41334 | 8/1999 |
| WO | 02/070629 | 9/2002 |
| WO | 2005/037967 | 4/2005 |
| WO | 2005/090528 | 9/2005 |
| WO | 2006/043709 | 4/2006 |
| WO | 2007/001000 | 1/2007 |
| WO | 2007/105769 | 9/2007 |
| WO | 2007/114132 | 10/2007 |
| WO | 2007/114260 | 10/2007 |
| WO | 2007/116759 | 10/2007 |
| WO | 2007/119299 | 10/2007 |
| WO | 2007/123266 | 11/2007 |
| WO | 2007/133999 | 11/2007 |
| WO | 2008/072526 | 6/2008 |
| WO | 2008/093446 | 8/2008 |
| WO | 2008/123246 | 10/2008 |
| WO | 2008/123249 | 10/2008 |
| WO | 2009/007147 | 1/2009 |
| WO | 2009/072524 | 6/2009 |
| WO | 2009/090921 | 7/2009 |
| WO | 2009/119505 | 10/2009 |
| WO | 2010/041689 | 4/2010 |
| WO | 2010/041692 | 4/2010 |

OTHER PUBLICATIONS

Notification of Information Provision issued with respect to Japanese Patent Application No. 2009-135444, mailed Jun. 19, 2012.
U.S. Appl. No. 12/933,805 to Hajime Nakao et al., filed Sep. 21, 2010.
U.S. Appl. No. 12/934,374 to Kazuo Tagawa, filed Sep. 24, 2010.
U.S. Appl. No. 12/934,431 to Kazuo Tagawa et al., filed Sep. 24, 2010.
U.S. Appl. No. 12/934,472 to Kazuo Tagawa et al., filed Sep. 24, 2010.
"The Advent of Modern Hydroprocessing—The Evolution of Base Oil Technology—Part 2", Machinery Lubirication (Retrieved from: http://www.machinerylubrication.com/Read/493/base-oil-technology on May 14, 2012), May 1, 2003, XP55027093.
Search report from E.P.O. that issued with respect to European Patent Application No. 09819126 5, mailed May 23, 2012.
Search report from E.P.O. that issued with respect to European Patent Application No. 09819223.0, mailed May 23, 2012.
Search Report issued with respect to European Patent Application No. 12002743.8, mailed Aug. 16, 2012.
Search Report issued with respect to European Patent Application No. 12002744.6, mailed Aug. 16, 2012.
Office Action issued with respect to Indonesian Patent Application No. W00201003649, mailed Aug. 23, 2012.
Office Action issued with respect to Chinese Patent Application No. 200980110123.8, mailed Aug. 31, 2012.
Office Action issued with respect to Chinese Patent Application No. 200980110437.8, mailed Aug. 31, 2012.
Office Action issued with respect to European Patent Application No. 09723908.1, mailed Sep. 12, 2012.
Zimmerschied et al., "Crystalline Adducts of Urea with Linear Aliphatic Compounds", Industrial and Engineering Chemistry 42(7), Jul. 31, 1950, pp. 1300-1306.
Rowe et al., "Low-Temperature Performance Advantages for Oils Using Hydrodewaxed Base Stocks", SAE Technical Paper Series 831715, Jan. 1, 1983, pp. 1-14.
Speight, "Hydrocarbons from Petroleum", Handbook of Industrial Hydrocarbon Processes, Jan. 1, 2011, pp. 85-126.
Search Report issued with respect to European Patent Application No. 10783178.6, mailed Oct. 29, 2012.
English-language translation of International Preliminary Report on Patentability issued with respect to PCT/JP2009/055666, mailed Nov. 18, 2010.
English-language translation of International Preliminary Report on Patentability issued with respect to PCT/JP2009/055690, mailed Nov. 18, 2010.
Notification of Information Provision issued with respect to Japanese Patent Application No. 2008-261071, mailed Oct. 9, 2012.
Notification of Information Provision issued with respect to Japanese Patent Application No. 2008-261079, mailed Oct. 9, 2012.
Hiroshi Ohtsuka et al., "Separation of Straight—Chain Hydrocarbons from Petroleum Fractions by Means of Urea—Adduct Formation", Bulletin of the Faculty of Engineering, Hokkaido University, 40, Mar. 30, 1966, pp. 125-137, along with a partial English-language translation.
Yozo Oshima et al., "Monomethylparaffins in n—Paraffins Adducted from Petroleum Fractions", Sekiyu Gakkaishi, vol. 18, No. 6, 1975, pp. 497-502, along with a partial English-language translation.
Notification of Information Provision issued with respect to Japanese Patent App. No. 2008-261079, mailed Mar. 12, 2013.
Office Action issued with respect to Chinese Patent Application No. 200980149130.9, mailed Dec. 4, 2012.
Office Action issued with respect to Chinese Patent Application No. 201080024425.6, mailed Dec. 12, 2012.
Office Action issued with respect to Chinese Patent Application No. 201080024832.7, mailed Dec. 12, 2012.
Office Action issued with respect to U.S. Appl. No. 13/122,828, mailed Feb. 28, 2013.
Office Action issued with respect to U.S. Appl. No. 12/934,374, mailed Mar. 25, 2013.
Office Action issued with respect to U.S. Appl. No. 13/122,622, mailed Mar. 22, 2013.
Notification of Information Provision issued with respect to Japanese Patent App. No. 2008-006024, mailed May 14, 2013.
Japanese Office Action issued with respect to Japanese Patent Application No. 2008-261079, dated May 21, 2013.
Japanese Office Action issued with respect to Japanese Patent Application No. 2008-261070, dated Jul. 2, 2013.
E.P.O. Office Action issued with respect to European Patent Application No. 09723908.1, mailed Mar. 2, 2012.
English-language translation of International Preliminary Report on Patentability for PCT/JP2009/067163, mailed May 26, 2011.
English-language translation of International Preliminary Report on Patentability for PCT/JP2009/055667, mailed Nov. 18, 2010.
English-language translation of International Preliminary Report on Patentability for PCT/JP2009/067504, mailed May 26, 2011.
English-language translation of International Preliminary Report on Patentability for PCT/JP2009/067509, mailed May 26, 2011.
English-language translation of International Preliminary Report on Patentability for PCT/JP2010/050916, mailed Jan. 26, 2012.
English-language translation of International Preliminary Report on Patentability for PCT/JP2010/050921, mailed Jan. 26, 2011.
English-language translation of International Preliminary Report on Patentability for PCT/JP2010/057957, mailed Jan. 26, 2012.

(56) References Cited

OTHER PUBLICATIONS

English-language translation of International Preliminary Report on Patentability for PCT/JP2010/059196, mailed Jan. 26, 2012.
English-language translation of International Preliminary Report on Patentability for PCT/JP2010/064698, mailed Mar. 29, 2012.
International Search Report for PCT/JP2009/067504, mailed Dec. 28, 2009.
International Search Report for PCT/JP2009/055667, mailed Jun. 16, 2009.
International Search Report for PCT/JP2010/050916, mailed Apr. 13, 2010.
International Search Report for PCT/JP2010/050921, mailed Apr. 6, 2010.
International Search Report for PCT/JP2010/057957, mailed Aug. 17, 2010.
International Search Report for PCT/JP2010/059196, mailed Aug. 31, 2010.
International Search Report for PCT/JP2010/064698 (English and Japanese) , mailed Nov. 2, 2010.
J.P.O. Notice of Information Provision issued with respect to Japanese Patent Application No. 2008-078224, mailed May 15, 2012.
E.P.O. Search Report issued with respect to European Patent Application No. 09723908.1, mailed Jun. 29, 2011.
Sharma et al., "Predicting Low Temperature Lubricant Rheology Using Nuclear Magnetic Resonance Spectroscopy and Mass Spectrometry", Tribology Letters, vol. 16, No. 1-2, Feb. 2004, pp. 11-19.
Shinya Sato et al., "Separation of n-Paraffin and 1-Olefin in Shale Oil by Urea Adduct Method", Sekiyu Gakkaishi, vol. 39, No. 5, 1996, pp. 365-368 with partial English language translation.
English-language translation of International Preliminary Report on Patentability for PCT/JP2009/050233, mailed Jul. 29, 2010.
J.P.O. Notification of Information Provision issued with respect to Japanese Patent Application No. 2008-261070, mailed Jun. 26, 2012.
E.P.O. Search Report issued with respect to European Patent Application No. 09819226.3, mailed Jun. 21, 2012.
J.P.O. Notification of Information Provision issued with respect to Japanese Patent Application No. 2008-078570, mailed May 22, 2012.
E.P.O. Search Report issued with respect to patent family member European Patent Application No. 09701700.8, mailed Jul. 5, 2012.
Office Action issued with respect to Chinese Patent Application No. 200980110123.8, mailed Apr. 1, 2013.
Schiessler et al., "Urea and Thiourea Adduction of $C_5$-$C_{42}$-Hydrocarbons", *Journal of the American Chemical Society*, vol. 74, No. 7, pp. 1720-1723, Apr. 5, 1952.
Japanese Office Action issued with respect to Japanese Patent Appl. No. 2009-135369, dated Jul. 16, 2013.
Search Report issued with respect to European Patent Application No. 10783230.5, mailed Feb. 11, 2013.
Search Report issued with respect to European Patent Application No. 12008549.3, mailed Feb. 11, 2013.

* cited by examiner

LUBRICANT COMPOSITION

TECHNICAL FIELD

The present invention relates to a lubricating oil composition.

BACKGROUND ART

Lubricating oils have been used in the past in internal combustion engines, gearboxes and other mechanical devices to produce smoother functioning. Internal combustion engine lubricating oils (engine oils), in particular, must exhibit high performance under the high-performance, high-output and harsh operating conditions of internal combustion engines. Various additives such as anti-wear agents, metallic detergents ashless dispersants and antioxidants are therefore added to conventional engine oils to meet such performance demands (see Patent documents 1-3). The fuel efficiency performance required of lubricating oils has continued to increase in recent years, and this has led to application of various high-viscosity-index base oils or friction modifiers (see Patent document 4, for example).

[Patent document 1] Japanese Unexamined Patent Publication No. 2001-279287

[Patent document 2] Japanese Unexamined Patent Publication No. 2002-129182

[Patent document 3] Japanese Unexamined Patent Publication No. HEI 08-302378

[Patent document 4] Japanese Unexamined Patent Publication No. HEI 06-306384

DISCLOSURE OF THE INVENTION

Problems to be Solved by the Invention

However, the conventional lubricating base oils and viscosity index improvers have not always been satisfactory from the viewpoint of fuel efficiency and low-temperature viscosity characteristics.

Common methods known for achieving fuel efficiency involve reducing the kinematic viscosity of the product or increasing the viscosity index, i.e. multigrading by a combination of reducing the base oil viscosity and adding viscosity index improvers. However, lowering product viscosity and reducing base oil viscosity can lower the lubricating performance under severe lubrication conditions (high-temperature, high-shear conditions), resulting in wear and seizing, as well as leading to problems such as fatigue fracture.

To prevent such problems and maintain durability it is necessary to maintain a high-temperature high-shear viscosity (HTHS viscosity) at 150° C. That is, for further fuel efficiency while maintaining practical performance, it is important to maintain the HTHS viscosity at 150° C. and to lower the kinematic viscosities at 40° C. and 100° C., and the HTHS viscosity at 100° C., to increase the viscosity index.

As one method of improving low-temperature performance, it is possible to lower the kinematic viscosities at 40° C. and 100° C. and lower the base oil viscosity and achieve multigrading by addition of a viscosity index improver, but reduced product viscosity and lower base oil viscosity can reduce the lubricating performance under severe lubrication conditions (high-temperature, high-shear conditions), potentially leading to problems such as wear, seizing and fatigue fracture. Although this is possible if combined with the use of lubricating base oils that exhibit excellent low temperature viscosity, such as synthetic oils including poly-α-olefin base oils or ester base oils, or low-viscosity mineral oil base oils, such synthetic oils are expensive, while low-viscosity mineral oil base oils generally have low viscosity indexes and high NOACK evaporation, and therefore addition of such lubricating base oils increases production costs for lubricating oils and makes it difficult to achieve a high viscosity index and low evaporation properties. Moreover, only limited improvement in fuel efficiency can be achieved when these conventional lubricating base oils are used.

The present invention has been accomplished in light of these circumstances, and its object is to provide a lubricating oil composition with excellent fuel efficiency and low viscosity at low temperature, which exhibits both fuel efficiency and low viscosity at below −35° C. while maintaining high-temperature high-shear viscosity at 150° C., even without using a synthetic oil such as a poly-α-olefin base oil or ester base oil, or a low-viscosity mineral base oil, and especially being effective for improved fuel efficiency by having notably reduced the kinematic viscosites at 40° C. and 100° C., and the HTHS viscosity at 100° C. while also exhibiting the low MRV viscosity at −40° C.

Means for Solving the Problems

In order to solve the problems described above, the invention provides a lubricating oil composition comprising:

a lubricating base oil having a kinematic viscosity at 100° C. of 1-10 $mm^2/s$, a % $C_p$ of 70 or greater and a % $C_A$ of not greater than 2;

a first viscosity index improver of 0.01-10% by mass, based on the total weight of the composition, wherein the first viscosity index improver is a poly(meth)acrylate having a weight-average molecular weight of not greater than 100,000; and a second viscosity index improver of 0.01-50% by mass, based on the total weight of the composition, wherein the second viscosity index improver is a polymer having a weight-average molecular weight of 100,000 or greater and containing a structural unit represented by the following formula (1) in a proportion of 0.5-70 mol %, the composition having a kinematic viscosity at 100° C. of 4-12 $mm^2/s$ and a viscosity index of 140-300.

[Chemical Formula 1]

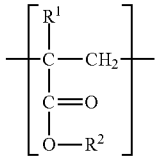

(1)

wherein (1), $R^1$ represents hydrogen or a methyl group and $R^2$ represents a C16 or greater straight-chain or branched hydrocarbon, or an oxygen- and/or nitrogen-containing C16 or greater straight-chain or branched organic group.]

The first viscosity index improver is preferably a (meth) acrylate copolymer containing a C1-18 hydrocarbon group.

The second viscosity index improver is preferably a dispersant poly(meth)acrylate.

Also, the second viscosity index improver preferably has a PSSI of not greater than 40 and a ratio of weight-average molecular weight/PSSI of $1\times10^4$ or greater.

The abbreviation "PSSI" used for the invention stands for the "Permanent Shear Stability Index" of the polymer, which is calculated according to ASTM D 6022-01 (Standard Practice for Calculation of Permanent Shear Stability Index) based on data measured according to ASTM D 6278-02 (Test Method for Shear Stability of Polymer Containing Fluids Using a European Diesel Injector Apparatus).

The second viscosity index improver preferably has a C20 or greater branched hydrocarbon group as $R^2$ in formula (1).

The lubricating oil composition of the invention preferably also contains at least one friction modifier selected from among organic molybdenum compounds and ash-free friction modifiers.

Effect of the Invention

The lubricating oil composition of the invention has excellent fuel efficiency and low temperature viscosity, and can exhibit both fuel efficiency and low viscosity at below −35° C. while maintaining the HTHS viscosity at 150° C., even without using a synthetic oil such as a poly-α-olefin base oil or ester base oil, or a low-viscosity mineral base oil, and in particular it can reduce the HTHS viscosity at 100° C. and notably improve the MRV viscosity at −40° C. of the lubricating oil.

The lubricating oil composition of the invention is also useful for gasoline engines, diesel engines and gas engines for two-wheel vehicles, four-wheel vehicles, electric power generation and cogeneration, while it can be suitably used not only for such engines that run on fuel with a sulfur content of not greater than 50 ppm by weight, but also for ship engines, outboard motor engines and the like.

BEST MODE FOR CARRYING OUT THE INVENTION

Preferred embodiments of the invention will now be described in detail.

The lubricating oil composition of the invention employs a lubricating base oil (hereunder referred to as "lubricating base oil of the invention") with a kinematic viscosity at 100° C. of 1-10 $mm^2/s$, a % $C_p$ of 70 or greater and a % $C_A$ or not greater than 2.

The lubricating base oil of the invention is not particularly restricted so long as it has a kinematic viscosity at 100° C., % $C_p$ and % $C_A$ satisfying the aforementioned conditions. Specifically, there may be mentioned refined paraffinic mineral oils produced by subjecting a lube-oil distillate obtained by atmospheric distillation and/or vacuum distillation of crude oil to a single treatment or two or more treatments from among refining treatments such as solvent deasphalting, solvent extraction, hydrocracking, solvent dewaxing, catalytic dewaxing, hydrorefining, sulfuric acid treatment or clay treatment, or normal-paraffinic base oils, isoparaffinic base oils and the like, whose the kinematic viscosity at 100° C., % $C_p$ and % $C_A$ satisfy the aforementioned conditions.

As a preferred example for the lubricating base oil of the invention there may be mentioned a base oil obtained by using one of the base oils (1)-(8) mentioned below as the raw material and purifying this stock oil and/or the lube-oil distillate recovered from the stock oil by a prescribed refining process, and recovering the lube-oil distillate.

(1) Distillated oil from atmospheric distillation of a paraffin-based crude oil and/or mixed-base crude oil.

(2) Distillated oil from vacuum distillation of the residue from atmospheric distillation of a paraffin-based crude oil and/or mixed-base crude oil (WVGO).

(3) Wax obtained by a lubricating oil dewaxing step (slack wax or the like) and/or synthetic wax obtained by a gas-to-liquid (GTL) process (Fischer-Tropsch wax, GTL wax or the like).

(4) Blended oil comprising one or more oils selected from among base oils (1)-(3) and/or mild-hydrocracked oil obtained from the blended oil.

(5) Blended oil comprising two or more selected from among base oils (1)-(4).

(6) Deasphalted oil (DAO) from base oil (1), (2), (3), (4) or (5).

(7) Mild-hydrocracked oil (MHC) obtained from base oil (6).

(8) Blended oil comprising two or more selected from among base oils (1)-(7).

The prescribed refining process described above is preferably hydrorefining such as hydrocracking or hydrofinishing; solvent refining such as furfural solvent extraction; dewaxing such as solvent dewaxing or catalytic dewaxing; clay treating with acidic clay or active clay, or chemical (acid or alkali) treatment such as sulfuric acid treatment or caustic soda treatment. According to the invention, any one of these refining processes may be used alone, or a combination of two or more thereof may be used in combination. When a combination of two or more refining processes is used, their order is not particularly restricted and may be selected as appropriate.

The lubricating base oil of the invention is most preferably one of the following base oils (9) or (10) obtained by the prescribed treatment of a base oil selected from among base oils (1)-(8) above or a lube-oil distillate recovered from the base oil.

(9) Hydrocracked mineral oil obtained by hydrocracking of a base oil selected from among base oils (1)-(8) above or a lube-oil distillate recovered from the base oil, dewaxing treatment such as solvent dewaxing or catalytic dewaxing of the product or a lube-oil distillate recovered from distillation of the product, or further distillation after the dewaxing treatment.

(10) Hydroisomerized mineral oil obtained by hydroisomerization of a base oil selected from among base oils (1)-(8) above or a lube-oil distillate recovered from the base oil, and dewaxing treatment such as solvent dewaxing or catalytic dewaxing of the product or a lube-oil distillate recovered from distillation of the product, or further distillation after the dewaxing treatment.

In obtaining the lubricating base oil of (9) or (10) above, a solvent refining treatment and/or hydrofinishing treatment step may also be carried out by convenient steps if necessary.

There are no particular restrictions on the catalyst used for the hydrocracking and hydroisomerization, but there are preferably used hydrocracking catalysts comprising a hydrogenating metal (for example, one or more metals of Group VIa or metals of Group VIII of the Periodic Table) supported on a carrier which is a complex oxide with cracking activity (for example, silica-alumina, alumina-boria, silica-zirconia or the like) or a combination of two or more of such complex oxides bound with a binder, or hydroisomerization catalysts obtained by supporting one or more metals of Group VIII having hydrogenating activity on a carrier comprising zeolite (for example, ZSM-5, zeolite beta, SAPO-11 or the like). The hydrocracking catalyst or hydroisomerization catalyst may be used as a combination of layers or a mixture.

The reaction conditions for hydrocracking and hydroisomerization are not particularly restricted, but preferably the hydrogen partial pressure is 0.1-20 MPa, the mean reaction temperature is 150-450° C., the LHSV is 0.1-3.0 $hr^{-1}$ and the hydrogen/oil ratio is 50-20,000 scf/b.

The kinematic viscosity at 100° C. of the lubricating base oil of the invention must be not greater than 10 $mm^2/s$, and it is preferably not greater than 9 $mm^2/s$, more preferably not greater than 7 $mm^2/s$, even more preferably not greater than 5.0 $mm^2/s$, particularly preferably not greater than 4.5 $mm^2/s$ and most preferably not greater than 4.0 $mm^2/s$. The kinematic viscosity at 100° C., on the other hand, must be 1 $mm^2/s$ or greater, and it is preferably 1.5 $mm^2/s$ or greater, more preferably 2 $mm^2/s$ or greater, even more preferably 2.5 $mm^2/s$ or greater and most preferably 3 $mm^2/s$ or greater. The kinematic viscosity at 100° C. is the kinematic viscosity at 100° C. measured according to ASTM D-445. If the kinematic viscosity at 100° C. of the lubricating base oil component exceeds 10 $mm^2/s$, the low-temperature viscosity characteristic may be impaired and sufficient fuel efficiency may not be obtained, while if it is 1 $mm^2/s$ or lower, oil film formation at the lubricated surfaces will be inadequate, resulting in inferior lubricity and potentially large evaporation loss of the lubricating oil composition.

According to the invention, lubricating base oils having a kinematic viscosity at 100° C. in the following ranges are preferably used after fractionation by distillation or the like.

(I) A lubricating base oil with a kinematic viscosity at 100° C. of 1.5 $mm^2/s$ or greater and less than 3.5 $mm^2/s$, and more preferably 2.0-3.0 $mm^2/s$.

(II) A lubricating base oil with a kinematic viscosity at 100° C. of 3.5 $mm^2/s$ or greater and less than 4.5 $mm^2/s$, and more preferably 3.5-4.1 $mm^2/s$.

(III) A lubricating base oil with a kinematic viscosity at 100° C. of 4.5-10 $mm^2/s$, more preferably 4.8-9 $mm^2/s$ and most preferably 5.5-8.0 $mm^2/s$.

The kinematic viscosity at 40° C. of the lubricating base oil of the invention is preferably not greater than 80 $mm^2/s$, more preferably not greater than 50 $mm^2/s$, even more preferably not greater than 20 $mm^2/s$, yet more preferably not greater than 18 $mm^2/s$ and most preferably not greater than 16 $mm^2/s$. The kinematic viscosity at 40° C. is also preferably 6.0 $mm^2/s$ or greater, more preferably 8.0 $mm^2/s$ or greater, even more preferably 12 $mm^2/s$ or greater, yet more preferably 14 $mm^2/s$ or greater and most preferably 15 $mm^2/s$ or greater. If the kinematic viscosity at 40° C. of the lubricating base oil component exceeds 80 $mm^2/s$, the low-temperature viscosity characteristic may be impaired and sufficient fuel efficiency may not be obtained, while if it is lower than 6.0 $mm^2/s$, oil film formation at the lubricated surfaces will be inadequate, resulting in inferior lubricity and potentially large evaporation loss of the lubricating oil composition. According to the invention, a lube-oil distillate having a kinematic viscosity at 40° C. in one of the following ranges is preferably used after fractionation by distillation or the like.

(IV) A lubricating base oil with a kinematic viscosity at 40° C. of 6.0 $mm^2/s$ or greater and less than 12 $mm^2/s$, and more preferably 8.0-12 $mm^2/s$.

(V) A lubricating base oil with a kinematic viscosity at 40° C. of 12 $mm^2/s$ or greater and less than 28 $mm^2/s$, and more preferably 13-19 $mm^2/s$.

(VI) A lubricating base oil with kinematic viscosity at 40° C. of 28-50 $mm^2/s$, more preferably 29-45 $mm^2/s$ and most preferably 30-40 $mm^2/s$.

The viscosity index of the lubricating base oil of the invention is preferably 120 or greater. Also, the viscosity index for the lubricating base oils (I) and (IV) is preferably 120-135 and more preferably 120-130. The viscosity index for the lubricating base oils (II) and (V) is preferably 120-160, more preferably 125-150 and even more preferably 135-145. Also, the viscosity index for the lubricating base oils (III) and (VI) is preferably 120-180 and more preferably 125-160. A viscosity index below these lower limits will not only impair the viscosity-temperature characteristic, thermal and oxidation stability and resistance to volatilization, but will also tend to increase the frictional coefficient and potentially lower the anti-wear property. If the viscosity index exceeds the aforementioned upper limit, the low-temperature viscosity characteristic will tend to be impaired.

The viscosity index for the purpose of the invention is the viscosity index measured according to JIS K 2283-1993.

The 15° C. density (ρ15) of the lubricating base oil of the invention will also depend on the viscosity grade of the lubricating base oil component, but it is preferably not greater than the value of ρ represented by the following formula (A), i.e., $\rho 15 \leq \rho$.

$$\rho = 0.0025 \times kv100 + 0.816 \quad (A)$$

[In this equation, kv100 represents the kinematic viscosity at 100° C. ($mm^2/s$) of the lubricating base oil component.]

If $\rho 15 > \rho$, the viscosity-temperature characteristic and thermal and oxidation stability, as well as the resistance to volatilization and low-temperature viscosity characteristic, will tend to be lowered, thus potentially impairing the fuel efficiency. In addition, the efficacy of additives included in the lubricating base oil component may be reduced.

Specifically, the 15° C. density (ρ15) of the lubricating base oil of the invention is preferably not greater than 0.860, more preferably not greater than 0.850, even more preferably not greater than 0.840 and most preferably not greater than 0.822.

The 15° C. density for the purpose of the invention is the density measured at 15° C. according to JIS K 2249-1995.

The pour point of the lubricating base oil of the invention will depend on the viscosity grade of the lubricating base oil, and for example, the pour point for the lubricating base oils (I) and (IV) is preferably not higher than −10° C., more preferably not higher than −12.5° C. and even more preferably not higher than −15° C. Also, the pour point for the lubricating base oils (II) and (V) is preferably not higher than −10° C., more preferably not higher than −15° C. and even more preferably not higher than −17.5° C. The pour point for the lubricating base oils (III) and (VI) is preferably not higher than −10° C., more preferably not higher than −12.5° C. and even more preferably not higher than −15° C. If the pour point exceeds the upper limit specified above, the low-temperature flow properties of lubricating oils employing the lubricating base oils will tend to be reduced. The pour point for the purpose of the invention is the pour point measured according to JIS K 2269-1987.

The aniline point (AP (° C.)) of the lubricating base oil of the invention will also depend on the viscosity grade of the lubricating base oil, but it is preferably greater than or equal to the value of A as represented by the following formula (B), i.e., $AP \geq A$.

$$A = 4.3 \times kv100 + 100 \quad (B)$$

[In this equation, kv100 represents the kinematic viscosity at 100° C. ($mm^2/s$) of the lubricating base oil.]

If $AP < A$, the viscosity-temperature characteristic, thermal and oxidation stability, resistance to volatilization and low-temperature viscosity characteristic of the lubricating base oil will tend to be reduced, while the efficacy of additives when added to the lubricating base oil will also tend to be reduced.

The AP for the lubricating base oils (I) and (IV) is preferably 108° C. or higher and more preferably 110° C. or higher. The AP for the lubricating base oils (II) and (V) is preferably 113° C. or higher and more preferably 119° C. or higher. Also, the AP for the lubricating base oils (III) and (VI) is preferably 125° C. or higher and more preferably 128° C. or higher. The aniline point for the purpose of the invention is the aniline point measured according to JIS K 2256-1985.

The iodine value of the lubricating base oil of the invention is preferably not greater than 3, more preferably not greater than 2, even more preferably not greater than 1, yet more preferably not greater than 0.9 and most preferably not greater than 0.8. Although the value may be less than 0.01, in consideration of the fact that this does not produce any further significant effect and is uneconomical, the value is preferably 0.001 or greater, more preferably 0.01 or greater, even more preferably 0.03 or greater and most preferably 0.05 or greater. Limiting the iodine value of the lubricating base oil component to not greater than 3 can drastically improve the thermal and oxidation stability. The "iodine value" for the purpose of the invention is the iodine value measured by the indicator titration method according to JIS K 0070, "Acid Values, Saponification Values, Iodine Values, Hydroxyl Values And Unsaponification Values Of Chemical Products".

The sulfur content in the lubricating base oil of the invention will depend on the sulfur content of the starting material. For example, when using a substantially sulfur-free starting material as for synthetic wax components obtained by Fischer-Tropsch reaction, it is possible to obtain a substantially sulfur-free lubricating base oil. When using a sulfur-containing starting material, such as slack wax obtained by a lubricating base oil refining process or microwax obtained by a wax refining process, the sulfur content of the obtained lubricating base oil will normally be 100 ppm by weight or greater. From the viewpoint of further improving the thermal and oxidation stability and reducing sulfur, the sulfur content in the lubricating base oil of the invention is preferably not greater than 100 ppm by weight, more preferably not greater than 50 ppm by weight, even more preferably not greater than 10 ppm by weight and especially not greater than 5 ppm by weight.

The nitrogen content in the lubricating base oil of the invention is not particularly restricted, but is preferably not greater than 7 ppm by weight, more preferably not greater than 5 ppm by weight and even more preferably not greater than 3 ppm by weight. If the nitrogen content exceeds 5 ppm by weight, the thermal and oxidation stability will tend to be reduced. The nitrogen content for the purpose of the invention is the nitrogen content measured according to JIS K 2609-1990.

The % $C_p$ value of the lubricating base oil of the invention must be 70 or greater, and it is preferably 80-99, more preferably 85-95, even more preferably 87-94 and most preferably 90-94. If the % $C_p$ value of the lubricating base oil is less than the aforementioned lower limit, the viscosity-temperature characteristic, thermal and oxidation stability and frictional properties will tend to be reduced, while the efficacy of additives when added to the lubricating base oil will also tend to be reduced. If the % $C_p$ value of the lubricating base oil is greater than the aforementioned upper limit, on the other hand, the additive solubility will tend to be lower.

The % $C_A$ of the lubricating base oil of the invention must be not greater than 2, and it is more preferably not greater than 1, even more preferably not greater than 0.8 and most preferably not greater than 0.5. If the % $C_A$ value of the lubricating base oil exceeds the aforementioned upper limit, the viscosity-temperature characteristic, thermal and oxidation stability and fuel efficiency will tend to be reduced.

The % $C_N$ value of the lubricating base oil of the invention is preferably not greater than 30, more preferably 4-25, even more preferably 5-13 and most preferably 5-8. If the % $C_N$ value of the lubricating base oil exceeds the aforementioned upper limit, the viscosity-temperature characteristic, thermal and oxidation stability and frictional properties will tend to be reduced. If the % $C_N$ is less than the aforementioned lower limit, the additive solubility will tend to be lower.

The % $C_P$, % $C_N$ and % $C_A$ values for the purpose of the invention are, respectively, the percentage of paraffinic carbons with respect to total carbon atoms, the percentage of naphthenic carbons with respect to total carbons and the percentage of aromatic carbons with respect to total carbons, as determined by the method of ASTM D 3238-85 (n-d-M ring analysis). That is, the preferred ranges for % $C_P$, % $C_N$ and % $C_A$ are based on values determined by these methods, and for example, % $C_N$ may be a value exceeding 0 according to these methods even if the lubricating base oil contains no naphthene portion.

The content of saturated components in the lubricating base oil of the invention is not particularly restricted so long as the kinematic viscosity at 100° C., % $C_p$ and % $C_A$ values satisfy the conditions specified above, but it is preferably 90% by mass or greater, more preferably 95% by mass or greater and even more preferably 99% by mass or greater based on the total weight of the lubricating base oil, while the proportion of cyclic saturated components among the saturated components is preferably not greater than 40% by mass, more preferably not greater than 35% by mass, even more preferably not greater than 30% by mass, yet more preferably not greater than 25% by mass and most preferably not greater than 21% by mass. The proportion of cyclic saturated components among the saturated components is preferably 5% by mass or greater and more preferably 10% by mass or greater. If the content of saturated components and proportion of cyclic saturated components among the saturated components both satisfy these respective conditions, it will be possible to improve the viscosity-temperature characteristic and thermal and oxidation stability, while additives added to the lubricating base oil will be kept in a sufficiently stable dissolved state in the lubricating base oil so that the functions of the additives can be exhibited at a higher level. The invention also improves the frictional properties of the lubricating base oil itself, and thus results in a greater friction reducing effect and therefore increased energy savings.

The "saturated components" for the purpose of the invention are measured by the method of ASTM D 2007-93.

Other methods may be used for separation of the saturated components or for compositional analysis of the cyclic saturated components and acyclic saturated components, so long as they provide similar results. As examples of other methods there may be mentioned the method according to ASTM D 2425-93, the method according to ASTM D 2549-91, methods of high performance liquid chromatography (HPLC), and modified forms of these methods.

The aromatic content in the lubricating base oil of the invention is not particularly restricted so long as the kinematic viscosity at 100° C., % $C_p$ and % $C_A$ values satisfy the conditions specified above, but it is preferably not greater than 5% by mass, more preferably not greater than 4% by mass, even more preferably not greater than 3% by mass and most preferably not greater than 2% by mass, and also preferably 0.1% by mass or greater, more preferably 0.5% by mass or greater, even more preferably 1% by mass or greater and most preferably 1.5% by mass or greater, based on the total weight of the lubricating base oil. If the aromatic content exceeds the aforementioned upper limit, the viscosity-temperature characteristic, thermal and oxidation stability, frictional properties, resistance to volatilization and low-temperature viscosity characteristic will tend to be reduced, while the efficacy of additives when added to the lubricating base oil will also tend to be reduced. The lubricating base oil of the invention may be free of aromatic components, but the solubility of additives can be further increased with an aromatic content above the aforementioned lower limit.

The aromatic content, according to the invention, is the value measured according to ASTM D 2007-93. The aromatic portion normally includes alkylbenzenes and alkylnaphthalenes, as well as anthracene, phenanthrene and their alkylated forms, compounds with four or more fused benzene rings, and heteroatom-containing aromatic compounds such as pyridines, quinolines, phenols, naphthols and the like.

The lubricating oil composition of the invention may be used alone as a lubricating base oil according to the invention, or the lubricating base oil of the invention may be combined with one or more other base oils. When the lubricating base oil of the invention is combined with another base oil, the proportion of the lubricating base oil of the invention of the total mixed base oil is preferably 30% by mass or greater, more preferably 50% by mass or greater, and even more preferably 70% by mass or greater.

There are no particular restrictions on the other base oil used in combination with the lubricating base oil of the invention, and as examples of mineral oil base oils there may be mentioned solvent refined mineral oils, hydrocracked mineral oil, hydrorefined mineral oils and solvent dewaxed base oils having a kinematic viscosities at 100° C. of 1-100 $mm^2/s$ and % $C_p$ and % $C_A$ values that do not satisfy the aforementioned conditions.

As synthetic base oils there may be mentioned poly-α-olefins and their hydrogenated forms, isobutene oligomers and their hydrogenated forms, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, which have kinematic viscosities at 100° C. that do not satisfy the conditions specified above, and poly-α-olefins are preferred among these. As typical poly-α-olefins there may be mentioned C2-32 and preferably C6-16 α-olefin oligomers or co-oligomers (1-octene oligomer, decene oligomer, ethylene-propylene co-oligomers and the like), and their hydrogenated products.

There are no particular restrictions on the process for producing poly-α-olefins, and as an example there may be mentioned a process wherein an α-olefin is polymerized in the presence of a polymerization catalyst such as a Friedel-Crafts catalyst comprising a complex of aluminum trichloride or boron trifluoride with water, an alcohol (ethanol, propanol, butanol or the like) and a carboxylic acid or ester.

The first viscosity index improver used for the invention is poly(meth)acrylate having a weight-average molecular weight of not greater than 100,000. The first viscosity index improver may be a non-dispersant poly(meth)acrylate or dispersant poly(meth)acrylate.

The first viscosity index improver is preferably a copolymer of one or more (meth)acrylate monomers comprising a C1-30 hydrocarbon group as a side chain group, more preferably a copolymer of one or more (meth)acrylate monomers comprising a C1-20 hydrocarbon group as a side chain group, even more preferably a copolymer of one or more (meth)acrylate monomers comprising a C1-18 hydrocarbon group as a side chain group, and most preferably a copolymer of one or more (meth)acrylate monomers comprising a C10-18 hydrocarbon group as a side chain group.

When the first viscosity index improver is a dispersant poly(meth)acrylate, the first viscosity index improver may be a copolymer of a (meth)acrylate monomer comprising a C1-30 alkyl group as a side chain group and a monomer other than the (meth)acrylate monomer. As monomers other than (meth)acrylate monomers comprising C1-30 alkyl groups as side chain groups there may be mentioned, specifically, monomers with "dispersion groups" such as dimethylamino, diethylamino, dipropylamino, dibutylamino, anilino, toluidino, xylidino, acetylamino, benzoylamino, morpholino, pyrrolyl, pyrrolino, pyridyl, methylpyridyl, pyrrolidinyl, piperidinyl, quinonyl, pyrrolidonyl, pyrrolidono, imidazolino and pyrazino. Particularly preferred are poly(meth)acrylates comprising dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate and N-vinylpyrrolidone as monomers.

The PSSI (Permanent Shear Stability Index) of the first viscosity index improver is preferably not greater than 40, more preferably not greater than 30, even more preferably not greater than 20, yet more preferably not greater than 15 and most preferably not greater than 10. If the PSSI is greater than 40, the shear stability may be impaired and a poor low-temperature viscosity characteristic obtained.

The weight-average molecular weight (MW) of the first viscosity index improver must be not greater than 100,000, and it is preferably not greater than 80,000, more preferably not greater than 60,000 and even more preferably not greater than 50,000. The weight-average molecular weight is preferably 1000 or greater, more preferably 5000 or greater, even more preferably 10,000 or greater and most preferably 30,000 or greater. If the weight-average molecular weight is less than 1000, the effect of improved viscosity index and improved low-temperature viscosity characteristic will be minimal, potentially increasing cost, while if the weight-average molecular weight is greater than 100,000 the effects of improved shear stability and low-temperature viscosity characteristic may be impaired.

The ratio of the weight-average molecular weight and PSSI of the first viscosity index improver (MW/PSSI) is preferably $1\times10^4$ or greater, more preferably $1.5\times10^4$ or greater, even more preferably $2\times10^4$ or greater and most preferably $2.5\times10^4$ or greater. If the MW/PSSI ratio is less than $1\times10^4$, the viscosity-temperature characteristic and low-temperature viscosity characteristic may be impaired.

The first viscosity index improver content in the lubricating oil composition of the invention is 0.01-10% by mass, preferably 0.02-8% by mass, more preferably 0.05-5% by mass and most preferably 0.1-3% by mass, based on the total weight of the lubricating oil composition. A first viscosity index improver content of less than 0.01% by mass may impair the viscosity-temperature characteristic or low-temperature viscosity characteristic. A content of greater than 10% by mass may impair the viscosity-temperature characteristic or low-temperature viscosity characteristic while also drastically increasing production cost and requiring reduced base oil viscosity, and can thus risk lowering the lubricating performance under severe lubrication conditions (high-temperature, high-shear conditions), as well as causing problems such as wear, seizing and fatigue fracture.

The second viscosity index improver used for the invention is a polymer with a weight-average molecular weight of 100,000 or greater, and a proportion of 0.5-70 mol % of structural units represented by the following formula (1). The second viscosity index improver may be non-dispersant or dispersant, but it is preferably dispersant.

[Chemical Formula 2]

(1)

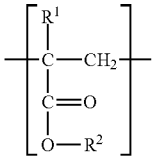

[In formula (1), $R^1$ represents hydrogen or a methyl group and $R^2$ represents a C16 or greater straight-chain or branched hydrocarbon, or an oxygen- and/or nitrogen-containing C16 or greater straight-chain or branched organic group.]

$R^2$ in formula (1) is a C16 or greater straight-chain or branched hydrocarbon group, as mentioned above, and is preferably a C18 or greater straight-chain or branched hydrocarbon, more preferably a C20 or greater straight-chain or branched hydrocarbon and even more preferably a C20 or greater branched hydrocarbon group. There is no particular upper limit on the hydrocarbon group represented by $R^2$, but it is preferably not greater than a C100 straight-chain or branched hydrocarbon group. It is more preferably a C50 or lower straight-chain or branched hydrocarbon, even more preferably a C30 or lower straight-chain or branched hydrocarbon, yet more preferably a C30 or lower branched hydrocarbon and most preferably a C25 or lower branched hydrocarbon.

The proportion of (meth)acrylate structural units represented by formula (1) in the polymer for the second viscosity index improver is 0.5-70 mol % as mentioned above, but it is preferably not greater than 60 mol %, more preferably not greater than 50 mol %, even more preferably not greater than 40 mol % and most preferably not greater than 30 mol %. It is also preferably 1 mol % or greater, more preferably 3 mol % or greater, even more preferably 5 mol % or greater and most preferably 10 mol % or greater. At greater than 70 mol % the viscosity-temperature characteristic-improving effect and the low-temperature viscosity characteristic may be impaired, and at below 0.5 mol % the viscosity-temperature characteristic-improving effect may be impaired.

The second viscosity index improver may comprise any (meth)acrylate structural unit other than a (meth)acrylate structural unit represented by formula (1), or any olefin-derived structural unit. A preferred mode of the second viscosity index improver is a copolymer obtained by copolymerizing one or more monomers represented by the following formula (2) (hereunder, "monomer (M-1)") and a monomer other than monomer (M-1).

[Chemical Formula 3]

(2)

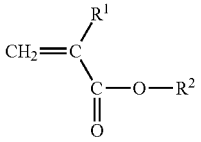

[In formula (2), $R^1$ represents hydrogen or a methyl group and $R^2$ represents a C16 or greater straight-chain or branched hydrocarbon group.]

Any monomer may be combined with monomer (M-1), but such a monomer is preferably one represented by the following formula (3) (hereunder, "monomer (M-2)"). The copolymer of monomer (M-1) and monomer (M-2) is a non-dispersant poly(meth)acrylate-based viscosity index improver.

[Chemical Formula 4]

(3)

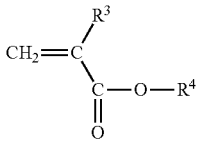

[In formula (3), $R^3$ represents hydrogen or methyl and $R^4$ represents a C1-15 straight-chain or branched hydrocarbon group.]

The other monomer to be combined with monomer (M-1) is preferably one or more selected from among monomers represented by the following formula (4) (hereunder, "monomer (M-3)") and monomers represented by the following formula (5) (hereunder, "monomer (M-4)"). The copolymer of monomer (M-1) and monomer (M-3) and/or (M-4) is a dispersant poly(meth)acrylate-based viscosity index improver. The dispersant poly(meth)acrylate-based viscosity index improver may further comprise monomer (M-2) as a constituent monomer.

[Chemical Formula 5]

(4)

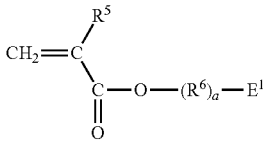

[In general formula (4), $R^5$ represents hydrogen or methyl, $R^6$ represents a C1-18 alkylene group, E1 represents an amine residue or heterocyclic residue containing 1-2 nitrogen atoms and 0-2 oxygen atoms, and a is 0 or 1.]

Specific examples of C1-18 alkylene groups represented by R6 include ethylene, propylene, butylene, pentylene, hexylene, heptylene, octylene, nonylene, decylene, undecylene, dodecylene, tridecylene, tetradecylene, pentadecylene, hexadecylene, heptadecylene and octadecylene (which alkylene groups may be straight-chain or branched).

Specific examples of groups represented by E1 include dimethylamino, diethylamino, dipropylamino, dibutylamino, anilino, toluidino, xylidino, acetylamino, benzoylamino, morpholino, pyrrolyl, pyrrolino, pyridyl, methylpyridyl, pyrrolidinyl, piperidinyl, quinonyl, pyrrolidonyl, pyrrolidono, imidazolino and pyrazino.

[Chemical Formula 6]

(5)

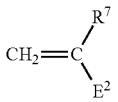

[In general formula (5), $R^7$ represents hydrogen or methyl and $E^2$ represents an amine residue or heterocyclic residue containing 1-2 nitrogen atoms and 0-2 oxygen atoms.]

Specific examples of groups represented by $E^2$ include dimethylamino, diethylamino, dipropylamino, dibutylamino, anilino, toluidino, xylidino, acetylamino, benzoylamino, morpholino, pyrrolyl, pyrrolino, pyridyl, methylpyridyl, pyrrolidinyl, piperidinyl, quinonyl, pyrrolidonyl, pyrrolidono, imidazolino and pyrazino.

Specific preferred examples for monomers (M-3) and (M-4) include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures of the foregoing.

There are no particular restrictions on the molar ratio of copolymerization in the copolymer of monomer (M-1) and monomers (M-2)-(M-4), but preferably the monomer (M-1): monomer (M-2)-(M-4) ratio is 0.5:99.5-70:30, more preferably 5:95-50:50 and even more preferably 10:90-40:60.

Any production process may be employed for the second viscosity index improver, and for example, it can be easily obtained by radical solution polymerization of monomer (M-1) and monomers (M-2)-(M-4) in the presence of a polymerization initiator such as benzoyl peroxide.

The PSSI (Permanent Shear Stability Index) of the second viscosity index improver is preferably not greater than 40, more preferably not greater than 35, even more preferably not greater than 30 and most preferably not greater than 25. It is also preferably 5 or greater, more preferably 10 or greater, even more preferably 15 or greater and most preferably 20 or greater. If the PSSI is less than 5 the viscosity index improving effect may be reduced and cost increased, while if the PSSI is greater than 40 the stability may be impaired.

The weight-average molecular weight (MW) of the second viscosity index improver must be 100,000 or greater, but it is more preferably 200,000 or greater, even more preferably 250,000 or greater and most preferably 300,000 or greater. It is also preferably not greater than 1,000,000, more preferably not greater than 700,000, even more preferably not greater than 600,000 and most preferably not greater than 500,000. If the weight-average molecular weight is less than 100,000, the effect of improving the viscosity-temperature characteristic and viscosity index will be minimal, potentially increasing cost, while if the weight-average molecular weight is greater than 1,000,000 the shear stability, solubility in the base oil and storage stability may be impaired.

The ratio of the weight-average molecular weight and PSSI of the second viscosity index improver (MW/PSSI) is preferably $0.8\times10^4$ or greater, more preferably $1.0\times10^4$ or greater, even more preferably $1.5\times10^4$ or greater, yet more preferably $1.8\times10^4$ and most preferably $2.0\times10^4$ or greater. If the MW/PSSI ratio is less than $0.8\times10^4$, the viscosity-temperature characteristic, i.e. the fuel efficiency, may be impaired.

The second viscosity index improver content in the lubricating oil composition of the invention is 0.01-50% by mass, but preferably 0.5-40% by mass, more preferably 1-30% by mass and even more preferably 5-20% by mass, based on the total weight of the composition. If the second viscosity index improver content is less than 0.1% by mass, the viscosity index improving effect or product viscosity reducing effect will be minimal, potentially preventing improvement in fuel efficiency. A content of greater than 50% by mass will drastically increase production cost while requiring reduced base oil viscosity, and can thus risk lowering the lubricating performance under severe lubrication conditions (high-temperature, high-shear conditions), as well as causing problems such as wear, seizing and fatigue fracture.

The lubricating oil composition of the invention may further contain, as viscosity index improvers in addition to the aforementioned first and second viscosity index improvers, also common non-dispersant or dispersant poly(meth) acrylates, non-dispersant or dispersant ethylene-α-olefin copolymers or their hydrogenated products ides, polyisobutylene or its hydrogenated products ides, styrene-diene hydrogenated copolymers, styrene-maleic anhydride ester copolymers and polyalkylstyrenes.

The lubricating oil composition of the invention may also contain at least one friction modifier selected from among organic molybdenum compounds and ash-free friction modifiers, in order to increase the fuel efficiency performance.

As organic molybdenum compounds to be used for the invention there may be mentioned sulfur-containing organic molybdenum compounds such as molybdenum dithiophosphate and molybdenum dithiocarbamate, complexes of molybdenum compounds (for example, molybdenum oxides such as molybdenum dioxide and molybdenum trioxide, molybdic acids such as orthomolybdic acid, paramolybdic acid and (poly)molybdic sulfide acid, molybdic acid salts such as metal salts or ammonium salts of these molybdic acids, molybdenum sulfides such as molybdenum disulfide, molybdenum trisulfide, molybdenum pentasulfide and polymolybdenum sulfide, molybdic sulfide, metal salts or amine salts of molybdic sulfide, halogenated molybdenums such as molybdenum chloride, and the like), with sulfur-containing organic compounds (for example, alkyl (thio)xanthates, thiadiazole, mercaptothiadiazole, thiocarbonate, tetrahydrocarbylthiuram disulfide, bis(di(thio)hydrocarbyl dithiophosphonate)disulfide, organic (poly)sulfides, sulfurized esters and the like), or other organic compounds, or complexes of sulfur-containing molybdenum compounds such as molybdenum sulfide and molybdic sulfide with alkenylsuccinic acid imides.

The organic molybdenum compound used may be an organic molybdenum compound containing no sulfur as a constituent element. As organic molybdenum compounds containing no sulfur as a constituent element there may be mentioned, specifically, molybdenum-amine complexes, molybdenum-succinic acid imide complexes, organic acid molybdenum salts, alcohol molybdenum salts and the like, among which molybdenum-amine complexes, organic acid molybdenum salts and alcohol molybdenum salts are preferred.

When an organic molybdenum compound is used in the lubricating oil composition of the invention, there are no particular restrictions on the content, but it is preferably 0.001% by mass or greater, more preferably 0.005% by mass or greater, even more preferably 0.01% by mass or greater and most preferably 0.03% by mass or greater, and also preferably not greater than 0.2% by mass, more preferably not greater than 0.1% by mass, even more preferably not greater than 0.08% by mass and most preferably not greater than 0.06% by mass, in terms of molybdenum element based on the total weight of the composition. If the content is less than 0.001% by mass the thermal and oxidation stability of the lubricating oil composition will be insufficient, and it may not be possible to maintain superior detergency for prolonged periods. On the other hand, if the content is greater than 0.2% by mass the effect will not be commensurate with the increased amount, and the storage stability of the lubricating oil composition will tend to be reduced.

The ash-free friction modifier used may be any compound commonly used as a friction modifier for lubricating oils, and as examples there may be mentioned ash-free friction modifiers that are amine compounds, fatty acid esters, fatty acid amides, fatty acids, aliphatic alcohols, aliphatic ethers and the like having one or more C6-30 alkyl or alkenyl and especially C6-30 straight-chain alkyl or straight-chain alkenyl groups in the molecule. There may also be mentioned one or more compounds selected from the group consisting of nitrogen-containing compounds represented by the following formulas (6) and (7) and their acid-modified derivatives, and the ash-free friction modifiers mentioned in International Patent Publication No. WO2005/037967.

[Chemical Formula 7]

(6)

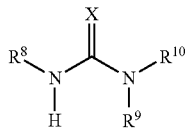

In formula (6), $R^8$ is a C1-30 hydrocarbon or functional C1-30 hydrocarbon group, preferably a C10-30 hydrocarbon or a functional C10-30 hydrocarbon, more preferably a C12-20 alkyl, alkenyl or functional hydrocarbon group and most preferably a C12-20 alkenyl group, $R^9$ and $R^{10}$ are each a C1-30 hydrocarbon or functional C1-30 hydrocarbon group or hydrogen, preferably a C1-10 hydrocarbon or functional C1-10 hydrocarbon group or hydrogen, more preferably a C1-4 hydrocarbon group or hydrogen and even more preferably hydrogen, and X is oxygen or sulfur and preferably oxygen.

[Chemical Formula 8]

(7)

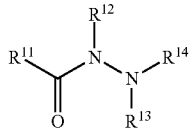

In formula (7), $R^{11}$ is a C1-30 hydrocarbon or functional C1-30 hydrocarbon group, preferably a C10-30 hydrocarbon or a functional C10-30 hydrocarbon, more preferably a C12-20 alkyl, alkenyl or functional hydrocarbon group and most preferably a C12-20 alkenyl group, and $R^{12}$-$R^{14}$ are each a C1-30 hydrocarbon or functional C1-30 hydrocarbon group or hydrogen, preferably a C1-10 hydrocarbon or functional C1-10 hydrocarbon group or hydrogen, more preferably a C1-4 hydrocarbon group or hydrogen and even more preferably hydrogen.

Nitrogen-containing compounds represented by general formula (7) include, specifically, hydrazides with C1-30 hydrocarbon or functional C1-30 hydrocarbon groups, and their derivatives. When $R^{11}$ is a C1-30 hydrocarbon or functional C1-30 hydrocarbon group and $R^{12}$-$R^{14}$ are hydrogen, they are hydrazides containing a C1-30 hydrocarbon group or functional C1-30 hydrocarbon group, and when any of $R^{11}$ and $R^{12}$-$R^{14}$ is a C1-30 hydrocarbon group or functional C1-30 hydrocarbon group and the remaining $R^{12}$-$R^{14}$ groups are hydrogen, they are N-hydrocarbyl hydrazides containing a C1-30 hydrocarbon group or functional C1-30 hydrocarbon group (hydrocarbyl being a hydrocarbon group or the like).

The ash-free friction modifier content of the lubricating oil composition according to the invention is preferably 0.01% by mass or greater, more preferably 0.1% by mass or greater and even more preferably 0.3% by mass or greater, and preferably not greater than 3% by mass, more preferably not greater than 2% by mass and even more preferably not greater than 1% by mass, based on the total weight of the composition. If the ash-free friction modifier content is less than 0.01% by mass the friction reducing effect by the addition will tend to be insufficient, while if it is greater than 3% by mass, the effects of the wear resistance additives may be inhibited, or the solubility of the additives may be reduced. An ash-free friction modifier is more preferably used as the friction modifier.

The lubricating oil composition of the invention may further contain any additives commonly used in lubricating oils, for the purpose of enhancing performance. As examples of such additives there may be mentioned additives such as metallic detergents, ashless dispersants, antioxidants, anti-wear agents (or extreme-pressure agents), corrosion inhibitors, rust-preventive agents, pour point depressants, demulsifiers, metal inactivating agents and antifoaming agents.

As metallic detergents there may be mentioned normal salts, basic normal salts and overbased salts such as alkali metal sulfonates or alkaline earth metal sulfonates, alkali metal phenates or alkaline earth metal phenates, and alkali metal salicylates or alkaline earth metal salicylates. According to the invention, it is preferred to use one or more alkali metal or alkaline earth metallic detergents selected from the group consisting of those mentioned above, and especially an alkaline earth metallic detergents. Preferred are magnesium salts and/or calcium salts, with calcium salts being particularly preferred.

As ashless dispersants there may be used any ashless dispersants used in lubricating oils, examples of which include mono- or bis-succinic acid imides with at least one C40-400 straight-chain or branched alkyl group or alkenyl group in the molecule, benzylamines with at least one C40-400 alkyl group or alkenyl group in the molecule, polyamines with at least one C40-400 alkyl group or alkenyl group in the molecule, and modified forms of the foregoing with boron compounds, carboxylic acids, phosphoric acids and the like. One or more selected from among any of the above may be added for use.

As antioxidants there may be mentioned phenol-based and amine-based ash-free antioxidants, and copper-based or molybdenum-based metal antioxidants. Specific examples include phenol-based ash-free antioxidants such as 4,4'-methylenebis(2,6-di-tert-butylphenol) and 4,4'-bis(2,6-di-tert-butylphenol), and amine-based ash-free antioxidants such as phenyl-α-naphthylamine, alkylphenyl-α-naphthylamine and dialkyldiphenylamine.

As anti-wear agents (or extreme-pressure agents) there may be used any anti-wear agents and extreme-pressure agents that are utilized in lubricating oils. For example, sulfur-based, phosphorus-based and sulfur/phosphorus-based extreme-pressure agents may be used, specific examples of which include phosphorous acid esters, thiophosphorous acid esters, dithiophosphorous acid esters, trithiophosphorous acid esters, phosphoric acid esters, thiophosphoric acid esters, dithiophosphoric acid esters and trithiophosphoric acid esters, as well as their amine salts, metal salts and derivatives, dithiocarbamates, zinc dithiocarbamate, molybdenum dithiocarbamate, disulfides, polysulfides, olefin sulfides, sulfurized fats and oils, and the like. Sulfur-based extreme-pressure agents, and especially sulfurized fats and oils, are preferably added.

As examples of corrosion inhibitors there may be mentioned benzotriazole-based, tolyltriazole-based, thiadiazole-based and imidazole-based compounds.

As examples of rust-preventive agents there may be mentioned petroleum sulfonates, alkylbenzene sulfonates, dinonylnaphthalene sulfonates, alkenylsuccinic acid esters and polyhydric alcohol esters.

Examples of pour point depressants that may be used include polymethacrylate-based polymers suitable for the lubricating base oil used.

As examples of demulsifiers there may be mentioned polyalkylene glycol-based nonionic surfactants such as polyoxyethylenealkyl ethers, polyoxyethylenealkylphenyl ethers and polyoxyethylenealkylnaphthyl ethers.

As examples of metal inactivating agents there may be mentioned imidazolines, pyrimidine derivatives, alkylthiadiazoles, mercaptobenzothiazoles, benzotriazole and its derivatives, 1,3,4-thiadiazolepolysulfide, 1,3,4-thiadiazolyl-2,5-bisdialkyl dithiocarbamate, 2-(alkyldithio)benzimidazole and β-(o-carboxybenzylthio)propionitrile.

As examples of antifoaming agents there may be mentioned silicone oils, alkenylsuccinic acid derivatives, polyhydroxyaliphatic alcohol and long-chain fatty acid esters, methyl salicylate and o-hydroxybenzyl alcohols, which have a kinematic viscosities at 25° C. of 1000-100,000 $mm^2/s$.

When such additives are added to a lubricating oil composition of the invention, their contents are 0.01-10% by mass based on the total weight of the composition.

The kinematic viscosity at 100° C. of the lubricating oil composition of the invention must be 4-12 $mm^2/s$, and it is preferably not greater than 9 $mm^2/s$, more preferably not greater than 8 $mm^2/s$, even more preferably not greater than 7.8 $mm^2/s$ and most preferably not greater than 7.6 $mm^2/s$. The kinematic viscosity at 100° C. of the lubricating oil composition of the invention is preferably 5 $mm^2/s$ or greater, more preferably 6 $mm^2/s$ or greater, even more preferably 6.5 $mm^2/s$ or greater and most preferably 7 $mm^2/s$ or greater. The kinematic viscosity at 100° C. at 100° C. is the kinematic viscosity at 100° C. measured according to ASTM D-445. If the kinematic viscosity at 100° C. is less than 4 $mm^2/s$, insufficient lubricity may result, and if it is greater than 12 $mm^2/s$ it may not be possible to obtain the necessary low temperature viscosity and sufficient fuel efficiency performance.

The kinematic viscosity at 40° C. of the lubricating oil composition of the invention is preferably 4-50 $mm^2/s$, more preferably not greater than 40 $mm^2/s$, even more preferably not greater than 35 $mm^2/s$, yet more preferably not greater than 32 $mm^2/s$ and most preferably not greater than 30 $mm^2/s$. The kinematic viscosity at 40° C. of the lubricating oil composition of the invention is preferably 10 $mm^2/s$ or greater, more preferably 20 $mm^2/s$ or greater, even more preferably 25 $mm^2/s$ or greater and most preferably 27 $mm^2/s$ or greater. The kinematic viscosity at 40° C. is the kinematic viscosity at 40° C. measured according to ASTM D-445. If the kinematic viscosity at 40° C. is less than 4 $mm^2/s$, insufficient lubricity may result, and if it is greater than 50 $mm^2/s$ it may not be possible to obtain the necessary low temperature viscosity and sufficient fuel efficiency performance.

The viscosity index of the lubricating oil composition of the invention must be in the range of 140-300, but it is preferably 190 or greater, more preferably 200 or greater, even more preferably 210 or greater and most preferably 220 or greater. If the viscosity index of the lubricating oil composition of the invention is less than 140 it may be difficult to maintain the HTHS viscosity at 150° C. while improving fuel efficiency, and it may also be difficult to lower the −35° C. low temperature viscosity. If the viscosity index of the lubricating oil composition of the invention is 300 or greater the evaporation property may be poor, and problems may occur due to solubility of the additives or lack of compatibility with the sealant material.

The HTHS viscosity at 100° C. of the lubricating oil composition of the invention is preferably not greater than 5.5 mPa·s, more preferably not greater than 5.0 mPa·s, even more preferably not greater than 4.8 mPa·s and most preferably not greater than 4.7 mPa·s. It is also preferably 3.0 mPa·s or greater, even more preferably 3.5 mPa·s or greater, yet more preferably 4.0 mPa·s or greater and most preferably 4.2 mPa·s or greater. The HTHS viscosity at 100° C. is the high-temperature high-shear viscosity at 100° C. according to ASTM D4683. If the HTHS viscosity at 100° C. is less than 3.0 mPa·s, insufficient lubricity may result, and if it is greater than 5.5 mPa·s it may not be possible to obtain the necessary low temperature viscosity and sufficient fuel efficiency performance.

The HTHS viscosity at 150° C. of the lubricating oil composition of the invention is preferably not greater than 3.5 mPa·s, more preferably not greater than 3.0 mPa·s, even more preferably not greater than 2.8 mPa·s and most preferably not greater than 2.7 mPa·s. It is also preferably 2.0 mPa·s or greater, more preferably 2.3 mPa·s or greater, even more preferably 2.4 mPa·s or greater, yet more preferably 2.5 mPa·s or greater and most preferably 2.6 mPa·s or greater. The HTHS viscosity at 150° C. is the high-temperature high-shear viscosity at 150° C. according to ASTM D4683. If the HTHS viscosity at 150° C. is less than 2.0 mPa·s, insufficient lubricity may result, and if it is greater than 3.5 mPa·s it may not be possible to obtain the necessary low temperature viscosity and sufficient fuel efficiency performance.

The lubricating oil composition of the invention has excellent fuel efficiency and lubricity, and is effective for improving fuel efficiency while maintaining a constant level for the HTHS viscosity at 150° C., even without using a synthetic oil such as poly-α-olefinic base oil or esteric base oil or a low-viscosity mineral oil base oil, because it reduces the kinematic viscosity at 40° C. and 100° C. and the HTHS viscosity at 100° C. of lubricating oils. The lubricating oil composition of the invention having such superior properties can be suitably employed as a fuel efficient engine oil, such as a fuel efficient gasoline engine oil or fuel efficient diesel engine oil.

EXAMPLES

The present invention will now be explained in greater detail based on examples and comparative examples, with the understanding that these examples are in no way limitative on the invention.

Examples 1-4, Comparative Examples 1-5

For Examples 1-4 and Comparative Examples 1-5 there were prepared lubricating oil compositions having the compositions shown in Table 2, using the base oils and additives listed below. The properties of base oils O-1, O-2 and O-3 are shown in Table 1.

(Base Oils)

O-1 (Base oil 1): Mineral oil obtained by hydrocracking/hydroisomerization of n-paraffin-containing oil O-2 (Base oil 2): Hydrocracked mineral oil O-3 (Base oil 3): Solvent refined mineral oil (Additives)

A-1: Non-dispersant polymethacrylate (copolymer of methacrylate with C12-18 alkyl group, Mw=60,000, PSSI=0.1)

A-2: Non-dispersant polymethacrylate (copolymer of methacrylate with C12-18 alkyl group, Mw=50,000, PSSI=0.1)

A-3: Non-dispersant polymethacrylate (copolymer of methyl methacrylate, methacrylate of formula (3) wherein $R^4$ is a C12 alkyl group, methacrylate of formula (3) wherein $R^4$ is a C13 alkyl group, methacrylate of formula (3) wherein $R^4$ is a C14 alkyl group, and methacrylate of formula (3) wherein $R^4$ is a C15 alkyl group; MW=80,000, Mw/Mn=2.7, PSSI=5)

A-4: Non-dispersant polymethacrylate (copolymer of methyl methacrylate, methacrylate of formula (3) wherein $R^4$ is a C12 alkyl group, methacrylate of formula (3) wherein $R^4$ is a C14 alkyl group and methacrylate of formula (2) wherein $R^2$ is a C16 alkyl group; MW=50,000, PSSI=0.1)

B-1: Dispersant polymethacrylate (dispersant polymethacrylate-based additive obtained by copolymerizing methyl methacrylate and dimethylaminoethyl methacrylate at a total of 70 mol %, methacrylate of formula (2) wherein $R^2$ is a C16 alkyl group, methacrylate of formula (2) wherein $R^2$ is a C18 alkyl group and methacrylate of formula (2) wherein $R^2$ is a C20 alkyl group at a total of 20 mol %, and methacrylate of formula (2) wherein $R^2$ is a C22 branched alkyl group at 10 mol %; MW=400,000, PSSI=20, Mw/Mn=2.2, Mw/PSSI=20,000)

B-2: Dispersant polymethacrylate (copolymer of methyl methacrylate, methacrylate of formula (3) wherein $R^4$ is a C12 alkyl group, methacrylate of formula (3) wherein $R^4$ is a C13 alkyl group, methacrylate of formula (3) wherein $R^4$ is a C14 alkyl group, and methacrylate of formula (3) wherein $R^4$ is a C15 alkyl group, and dimethylaminoethyl methacrylate; MW=300,000, PSSI=40, Mw/Mn=4.0, Mw/PSSI=7500)

C-1: Glycerin monooleate

C-2: Oleylurea

C-3: Molybdenum dithiocarbamate

D-1: Metallic detergents, ashless dispersants, antioxidant, anti-wear agent, pour point depressant, antifoaming agent, etc.

TABLE 1

| | | | Base oil 1 | Base oil 2 | Base oil 3 |
|---|---|---|---|---|---|
| Density (15° C.) | | | 0.820 | 0.8388 | 0.8637 |
| Kinematic viscosity (40° C.) | | g/cm³ | 15.8 | 18.72 | 22.77 |
| (100° C.) | | mm²/s | 3.854 | 4.092 | 4.413 |
| Viscosity index | | mm²/s | 141 | 120 | 103 |
| Pour point | | ° C. | −22.5 | −22.5 | −15 |
| Aniline point | | ° C. | 118.5 | 111.6 | 98.5 |
| Iodine value | | massppm | 0.06 | 0.79 | 3.82 |
| Sulfur content | | massppm | <1 | 2 | 1300 |
| Nitrogen content | | | <3 | <3 | 6 |
| n-d-M analysis | % $C_P$ | | 93.3 | 78 | 66.3 |
| | % $C_N$ | | 6.7 | 20.7 | 29.2 |
| | % $C_A$ | | 0 | 1.3 | 4.5 |
| Chromatographic separation | Saturated portion | mass % | 99.6 | 95.1 | 74.9 |
| | Aromatic portion | mass % | 0.2 | 4.7 | 24.9 |
| | Resin portion | mass % | 0.1 | 0.2 | 0.2 |
| | Yield | mass % | 99.9 | 100 | 100 |
| Paraffin content based on saturated portion | | mass % | 87.1 | 50.6 | 25.7 |
| Naphthene content based on saturated portion | | mass % | 12.9 | 49.4 | 74.3 |
| Distillation properties | IBP | ° C. | 363.0 | 324.6 | 301.0 |
| | 10% | ° C. | 396.0 | 383.4 | 367.4 |
| | 50% | ° C. | 432.0 | 420.1 | 415.5 |
| | 90% | ° C. | 459.0 | 457.8 | 456.7 |
| | FBP | ° C. | 489.0 | 494.7 | 507.2 |

[Evaluation of Lubricating Oil Composition]

Each of the lubricating oil compositions of Examples 1-4 and Comparative Examples 1-5 was measured for the kinematic viscosity at 40° C. or 100° C., viscosity index, the HTHS viscosity at 100° C. or 150° C. and the MRV viscosity at −40° C. The physical property values were measured by the following evaluation methods. The results are shown in Table 2.

(1) Kinematic viscosity: ASTM D-445

(2) Viscosity index: JIS K 2283-1993

(3) HTHS viscosity: ASTM D-4683

(4) MRV viscosity: ASTM D-4684

TABLE 2

| | | | Example 1 | Example 2 | Example 3 | Example 4 | Comp. Ex. 1 | Comp. Ex. 2 | Comp. Ex. 3 | Comp. Ex. 4 | Comp. Ex. 5 |
|---|---|---|---|---|---|---|---|---|---|---|---|
| Base oil | Based on total base oil | | | | | | | | | | |
| O-1 | Base oil 1 | mass % | 70 | 70 | 70 | 0 | 0 | 0 | 0 | 0 | 0 |
| O-2 | Base oil 2 | mass % | 30 | 30 | 30 | 100 | 0 | 100 | 100 | 100 | 100 |

TABLE 2-continued

| | | | | Example 1 | Example 2 | Example 3 | Example 4 | Comp. Ex. 1 | Comp. Ex. 2 | Comp. Ex. 3 | Comp. Ex. 4 | Comp. Ex. 5 |
|---|---|---|---|---|---|---|---|---|---|---|---|---|
| O-3 | Base oil 3 | | mass % | 0 | 0 | 0 | 0 | 100 | 0 | 0 | 0 | 0 |
| Additive | Based on total composition | | | | | | | | | | | |
| A-1 | Polymethacrylate | | mass % | 0.3 | 0.5 | 0.3 | 0.3 | 0.3 | | | | 0.3 |
| A-2 | Polymethacrylate | | mass % | | | | | | | 5.3 | 5.3 | |
| A-3 | Polymethacrylate | | mass % | | | | | | | | | |
| A-4 | Polymethacrylate | | mass % | | | | | | | | | |
| B-1 | Polymethacrylate | | mass % | 11.4 | 11.4 | 11.6 | 10.7 | 6.0 | 10.7 | | | |
| B-2 | Polymethacrylate | | mass % | | | | | | | | | 4.8 |
| C-1 | Friction modifier 1 | | mass % | 1 | 1 | | 1 | 1 | 1 | 1 | 1 | 1 |
| C-2 | Friction modifier 2 | | mass % | 0.3 | 0.3 | 0.5 | 0.3 | 0.3 | 0.3 | 0.3 | 0.3 | 0.3 |
| C-3 | Friction modifier 3 | | mass % | | | | | | | | | |
| D-1 | Other additives | | mass % | 11.5 | 11.5 | 11.5 | 11.5 | 11.5 | 11.5 | 11.5 | 11.5 | 11.5 |
| Evaluation results | | 40° C. | $mm^2/s$ | 30 | 31 | 30 | 33 | 41 | 33 | 38 | 34 | 41 |
| Kinematic viscosity | | 100° C. | $mm^2/s$ | 7.5 | 7.6 | 7.4 | 7.7 | 8.1 | 7.7 | 7.7 | 7.1 | 8.8 |
| Viscosity index | | | | 229 | 229 | 231 | 214 | 179 | 213 | 177 | 176 | 202 |
| HTHS viscosity | | 100° C. | mPa · s | 4.6 | 4.6 | 4.6 | 4.8 | 5.4 | 4.8 | 5.3 | 5.4 | 5.3 |
| | | 150° C. | mPa · s | 2.6 | 2.6 | 2.6 | 2.6 | 2.6 | 2.6 | 2.6 | 2.6 | 2.6 |
| MRV viscosity | | −40° C. | mPa · s | 9000 | 9200 | 8900 | 21500 | 45300 | Yield stress | 35600 | 32800 | — |

As shown in Table 2, the lubricating oil compositions of Examples 1-4 and Comparative Examples 1-5 had approximately equivalent HTHS viscosities at 150° C., but the lubricating oil compositions of Examples 1-4 had lower kinematic viscosities at 40° C., kinematic viscosities at 100° C., HTHS viscosities at 100° C. and MRV viscosities at −40° C., and thus more satisfactory low temperature viscosities and viscosity-temperature characteristics, than the lubricating oil compositions of Comparative Examples 1-5. These results demonstrate that the lubricating oil composition of the invention is a lubricating oil composition that has excellent fuel efficiency and low temperature viscosity, and can exhibit both fuel efficiency and low viscosity at below −35° C. while maintaining high-temperature high-shear viscosity at 150° C., even without using a synthetic oil such as poly-α-olefinic base oil or esteric base oil, or a low-viscosity mineral base oil, and in particular it can reduce the HTHS viscosity at 100° C. and notably improve the MRV viscosity at −40° C. of lubricating oils.

The invention claimed is:

1. A lubricating oil composition comprising:

a lubricating base oil having a kinematic viscosity at 100° C. of 1-10 $mm^2/s$, a viscosity index of 120 or greater, a % $C_p$ of 80 or greater and a % $C_A$ of not greater than 0.5;

a first viscosity index improver of 0.1-3% by mass, based on the total weight of the composition, wherein the first viscosity index improver is a poly(meth)acrylate having a weight-average molecular weight of not greater than 100,000; and a second viscosity index improver of 5-20% by mass, based on the total weight of the composition, wherein the second viscosity index improver has a PSSI of no greater than 40 and a ratio of weight-average molecular weight/PSSI of at least $1\times10^4$, and is a polymer having a weight-average molecular weight of 100,000 or greater and containing a structural unit represented by the following formula (1) in a proportion of 0.5-70 mol % and methyl methacrylate,

[Chemical Formula 1]

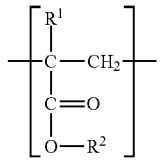

(1)

wherein $R^1$ represents hydrogen or a methyl group and $R^2$ represents a C22 or greater straight-chain or branched hydrocarbon, or an oxygen- and/or nitrogen-containing C22 or greater straight-chain or branched organic group, the composition having a kinematic viscosity at 100° C. of 4-12 $mm^2/s$ and a viscosity index of 140-300.

2. The lubricating oil composition according to claim 1, wherein the first viscosity index improver is a (meth)acrylate copolymer containing a C1-18 hydrocarbon group.

3. A lubricating oil composition according to claim 1, wherein the second viscosity index improver is a dispersant poly(meth)acrylate-based viscosity index improver.

4. The lubricating oil composition according to claim 1, wherein the second viscosity index improver contains a C22 or greater branched hydrocarbon group as $R^2$ in the formula (1).

5. The lubricating oil composition according to claim 1, further comprising at least one friction modifier selected from among organic molybdenum compounds and ash-free friction modifiers.

* * * * *